US005182731A

United States Patent [19]

Hoelscher et al.

[11] Patent Number: 5,182,731

[45] Date of Patent: Jan. 26, 1993

[54] WELL BORE DATA TRANSMISSION APPARATUS

[75] Inventors: Hans-Juergen Hoelscher, Hannover; Thomas Kerk, Clausthal-Zellerfeld; Wilfried Tuennermann, Giesen; Helmut Winnacker, Ehlershausen, all of Fed. Rep. of Germany

[73] Assignee: Preussag Aktiengesellschaft, Hannover, Fed. Rep. of Germany

[21] Appl. No.: 889,888

[22] Filed: May 29, 1992

[30] Foreign Application Priority Data

Aug. 8, 1991 [DE] Fed. Rep. of Germany ..... 4126249

[51] Int. Cl.[5] ..... G01V 1/40

[52] U.S. Cl. ..... 367/84

[58] Field of Search ..... 367/83, 84

[56] References Cited

U.S. PATENT DOCUMENTS

| | | | |
|---|---|---|---|
| Re. 29,734 | 8/1978 | Manning | 367/84 |
| 3,309,656 | 3/1967 | Godbey | 367/85 |
| 3,764,968 | 10/1973 | Anderson | 367/84 |
| 3,764,969 | 10/1973 | Cubberly, Jr. | 367/84 |
| 3,770,006 | 11/1973 | Sexton et al. | 367/83 |
| 3,982,224 | 9/1976 | Patton | 367/84 |
| 4,785,300 | 11/1988 | Chin et al. | 367/84 |
| 4,847,815 | 7/1989 | Malone | 367/84 |
| 4,914,637 | 4/1990 | Goodsman | 367/84 |

*Primary Examiner*—Ian J. Lobo

*Attorney, Agent, or Firm*—Nikaido, Marmelstein, Murray & Oram

[57] ABSTRACT

A hydromechanical signal transmitter for generating pressure pulses in a drilling fluid to transmit telemetry information of a well-logging operation includes a stator fixed in a cylindrical housing having at least a pair of axially aligned fluid passages, and a disc shaped rotor disposed between the passages, rotatable between a first limit position wherein an opening in the rotor passes drilling fluid flowing through the pair of passages and a second limit position wherein a disc portion of the rotor throttles the flow of the fluid. A revisable d.c. motor drives the rotor from one limit position to the other in response to information signals provided to the motor. Means is provided to stop the rotor at each limit position, including radial stop faces on a drive shaft connecting the motor to the rotor and a stop pin in the housing. A plurality of circumferentially spaced passages and rotor openings may be provided.

11 Claims, 4 Drawing Sheets

WELL BORE DATA TRANSMISSION APPARATUS

BACKGROUND OF THE INVENTION

This invention relates to a telemetry device for transmission of information in a liquid medium by generation of pressure pulses, especially for transmission of measured data from a well to the earth's surface during drilling, with a signal transmitter, which is installable in a conduit through which the liquid medium flows, and which has a stator that partly blocks the conduit and has at least one passage through which medium is passed from a side located upstream from the stator to a side located downstream from the stator. The device includes a rotor that can rotate in the conduit, that is adjacent to the stator and that has at least one opening and that, by means of the rotary movement, can be moved either into a throttling position in which the rotor throttles the flow of liquid medium through the passage in the stator or into a passing position in which the opening of the rotor permits a substantially unthrottled flow of liquid medium through the passage in the stator. By repeated movement of the rotor from the passing position into the throttling position and back into the passing position at controlled intervals, there can be generated a coded series of pressure pulses, which are transmitted by the liquid medium to a remote location and are picked up there by a receiver.

Telemetry devices of this type are employed in particular in directional drilling in order to transmit measured results determined underground during drilling, from logging instruments disposed in the drill string to the surface and, on the basis of these measured results, to permit influencing the progress of drilling to the desired extent.

Known applications for such telemetry devices are described in U.S. Pat. Nos. 3,309,656, 3,764,968, 3,764,969, 3,770,006 and 3,982,224. The telemetry devices in these cases are part of well-logging instruments for making measurements during drilling, which instruments are installed in the lower end of the drill string close to the bit and which transmit measured data in the form of pressure pulses through the drilling fluid to a receiver at the surface. The pressure pulses in these cases are generated by the rotor which is driven continuously in rotation by an electric motor, the angular velocity of the rotor being varied in order to change the pulse frequency, according to the data to be transmitted, by means of special mechanisms which are electrically activatable. These known instruments have proved to be large, laborious and expensive. Furthermore they need extensive and expensive energy systems and mechanisms in order to operate the telemetry devices, and so either large and expensive battery packs or turbine-driven generators are needed for entry generation. Furthermore the known instruments are installed permanently in the drill string and cannot be removed without dismantling the drill string.

From U.S. Pat. No. 4,914,637 there is known a well-logging instrument with a telemetry device of the type mentioned initially in which the rotor is disposed in the flow of drilling fluid and has blades that are impinged upon by the drilling-fluid flow, whereby a continuous torque acts on the rotor and in each case turns the rotor further in increments from one position to the next when a blocking device is released by which the rotor can be locked in a throttling position or a passing position. By virtue of this direct drive of the rotor by means of the drilling-fluid flow the demand for electrical energy is reduced in this known instrument, but the disadvantage nevertheless exists that the torque acting on the rotor varies depending on the position of the rotor, and so the blocking device is sometimes exposed to very large forces and is subject to relatively severe wear. Furthermore the torque of the rotor is strongly dependent on the hydraulic conditions of the drilling fluid, and so torque fluctuations can occur that interfere with signal generation and thus affect information transmission.

OBJECT OF THE INVENTION

The object of the invention is to provide a telemetry device of simple construction, low energy demand and interference-proof signal generation.

This object is achieved according to the invention by providing that the rotatability of the rotor is limited by fixed stops on the stator to an angle of rotation located between the passing position and the throttling position, that the rotor can be alternately moved, by a rotating motor with reversible direction of rotation, in one direction of rotation to the one step and in the opposite direction of rotation to the other stop, and that means are provided that hold the rotor in the passing or throttling position without activation of the rotating motor.

SUMMARY OF THE INVENTION

The telemetry device according to the invention has a simple construction, which needs few components and thus is inexpensive. Complex mechanisms for influencing the rotational movements of the rotor are not used, and electromagnetically actuatable control devices are not needed in order to block the rotor movement intermittently. Instead, a rotary drive is provided in the form of a rotating motor, which can be of relatively small and simple construction, since the rotor movement is limited to small angle of rotation and the resistance to rotation of the rotor is relatively low. Corresponding to these characteristics, the device according to the invention has small energy demand. Thus no problems arise in providing an energy source in the form of batteries to meet the energy demand for reasonable operating duration without the presence of additional devices for energy generation. A further advantage of the device according to the invention is the unambiguous nature of the generated signal, which is achieved by the fact that the two possible switching positions of the rotor, the passing position and the throttling position, each correlate unmistakably with a direction of rotation of the rotor. Thus a rotational movement in a given direction always leads to the rotor position being moved to a limit position corresponding to this direction of rotation, and so mistakes in signal identification, for example after a switching interference, are precluded.

A further embodiment of the invention provides that the rotor and stator are constructed and positioned relative to each other such that the rotor is held in each of its limit positions by hydraulic forces produced by the medium flowing through the passage in the stator and the opening in the rotor. In this connection, it has been found that, with suitable configuration of rotor and stator by forming a plurality of passages or openings at uniform spacings from one another, the rotor tends, by virtue of the hydraulic forces that occur, to move into the throttling position and remain there. For stabilization of the rotor in the passing position, the stop defining the passing position is positioned such that the respective opening of the rotor in the passing position is eccentrically offset in the direction of rotation of the rotor that brings about the passing position, relative to the mouth of the passage in the stator adjacent to the said opening. By virtue of the eccentric position of the opening, the hydraulic forces tend to turn the rotor further in the direction of the stop and thereby hold the rotor firmly in its passing position, against the stop. Thus continued activation of the rotating motor, or activation of another actuating device, is not necessary for stabilization of the rotor n its two limit positions. This also contributes to a reduction of energy demand.

A further embodiment of the invention provides that the passage in the stator has at least one conduit located upstream and one located downstream from the rotor, the mouths of the conduits adjacent to the rotor being coaxially aligned with each other and having substantially the same cross section. This embodiment has proved particularly favorable with regard to stabilization of the rotor in its two limit positions by means of the hydraulic forces. For the drive of the rotor there can be provided, according to the invention, a reversible d.c. motor, which is connectable to a battery via a time-controlled switch gear unit, the on-duration per switching-on operation being equal to o longer than the maximum time that the rotor need for its movement from one limit position to the other, and means being provided that switch off the d.c. motor when the rotor has reached its limit position at the respective stop. This embodiment of the rotor drive ensures that the rotor reaches its limit position in each case and permits a low current consumption, since the on-duration is adapted to the duration of the movement process as a function of the movement velocity.

As suitable means for switching off the d.c. motor before the end of the on-duration, it is provided according to the invention that, after the d.c. motor has started, the current input thereto is measured and an increase in current input that occurs when the rotor encounters its stop is processed as a signal for switching off the d.c. motor. Such a control arrangement is independent of the magnitude of the current input, which can undergo considerable fluctuations, and is therefore adapted advantageously to the different operating conditions. According to a further feature of the invention the d.c. motor can be switched from battery to generator operation during the switching-off process. Thereby the angular momentum can be decreased and the mechanical load on the rotor drive reduced.

According to the invention the generator circuit is made in a simple manner in that the d.c. motor is switched by means of power transistors that become nonconductive in the switching-off condition. The voltage building up after the d.c. motor is switched off provides for an opposing force that brakes the rotational movement of the armature. The braking action of the generator circuit contributes additionally to stabilization of the limit positions.

To reduce the mechanical load when the rotor encounters the fixed stops of the stator it is possible, according to a further feature of the invention, to connect the d.c. motor via a flexible coupling with the drive shaft of the rotor. For structural reasons it can also be expedient for the drive shaft of the rotor to have stop cams that cooperate with the stops on the stator. A compact construction of the device according to the invention can also be achieved by providing that the rotational movements of the d.c. motor are transmitted to the drive shaft through a step-down gear. The gear is designed such that the motor must perform several revolutions in order to move the rotor from the passing position to the throttling position.

Particularly for application of the telemetry device according to the invention in a probe that can be inserted in a drill string for the measurement of various parameters during drilling, it is expedient to encapsulate the rotor drive. For this purpose, it is provided according to the invention that the bearing of the drive shaft, the d.c. motor and, if necessary, the coupling and the step-down gear, are disposed in a pressure-tight housing compartment filled with a liquid medium of low viscosity, and that an equalizing piston that can be acted on by the surrounding pressure is disposed in an interior wall of the housing compartment. The liquid medium filing the housing compartment protects the assemblies located therein from dirt and corrosion and provides for suitable lubrication of the bearings of the rotatable structural components. By mean of the equalizing piston the pressure in the housing compartment is made equal to the surrounding pressure, so the housing compartment is not subjected to any large pressure loads even at high external pressures.

The invention will be explained in more detail in the following on the basis of a practical example that is illustrated in the drawings, wherein

DESCRIPTION OF PREFERRED EMBODIMENT

The illustrated measuring probe 1 has a housing 2 consisting of a plurality of housing parts screwed together with one another, which housing has the form of a cylinder, in which the individual assemblies such as measuring pick-up, measuring transducer, signal generator, signal transmitter and energy source are disposed. From FIGS. 1 and 2, only the upper end region, containing the signal transmitter of measuring probe 1 is visible.

At its upper end, the measuring probe 1 has a catch hook 3 formed in the manner of a spearhead, on which it can be held by means of a gripper (not shown). The probe suspended on a cable (not shown) can be run into a drill string as far as a holder close to the drill bit and, if necessary, also be withdrawn again. The outside diameter of the measuring probe 1 is smaller that the inside diameter of the drill pipes of the drill string, and so an annular shaped space remains between the measuring probe 1 and the wall of the drill pipes, through which space a flowing liquid medium, i.e, drilling fluid, pumped through the drill string reaches the drill bit. At its upper end the housing 2 of the probe 1 has guide ribs 4 directed radially outward, which ribs center the measuring probe 1 in the drill string and provide a constriction of the annular cross section surrounding the measuring probe 1. In the case of relatively large diameter differences between the outside of probe 1 and drill pipe wall, the guide ribs 4 can be additionally surrounded by a sleeve. Alternatively, comparable devices can be formed in the drill string in place of the guide ribs 4.

Figure 1:
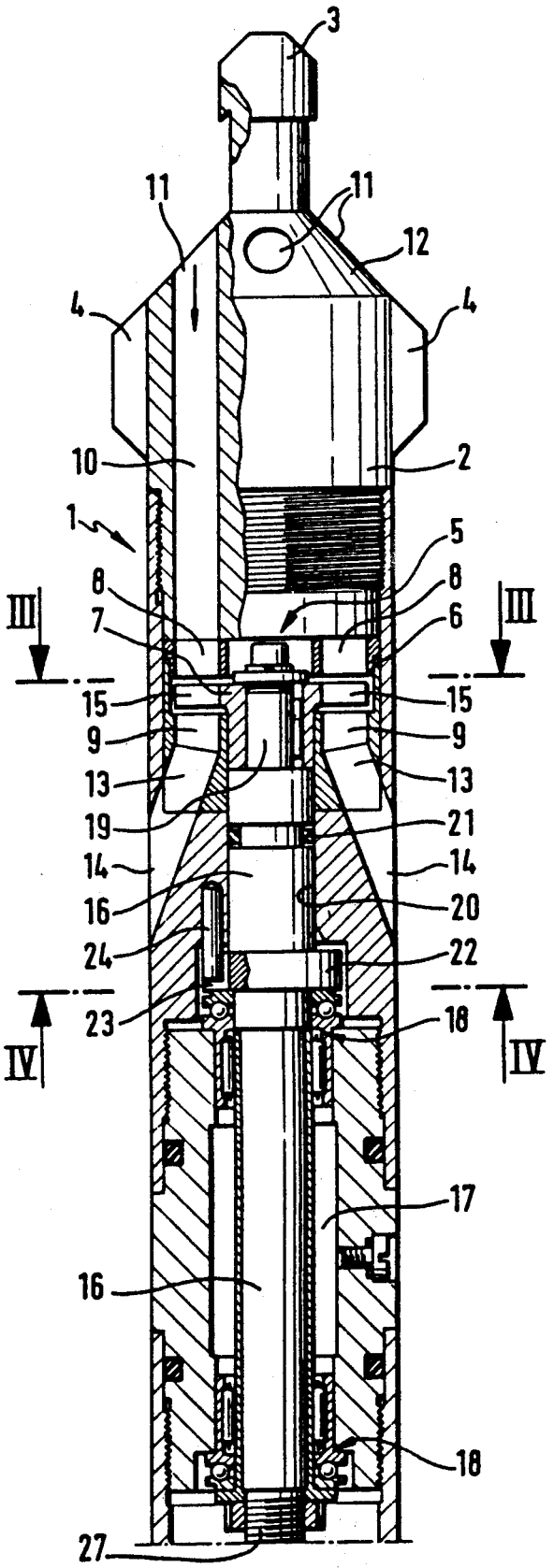
FIG. 1 shows a longitudinal section through the upper end portion, containing a signal transducer according to the invention, of a measuring probe for acquiring and communicating measured data during drilling.
Figure 2:
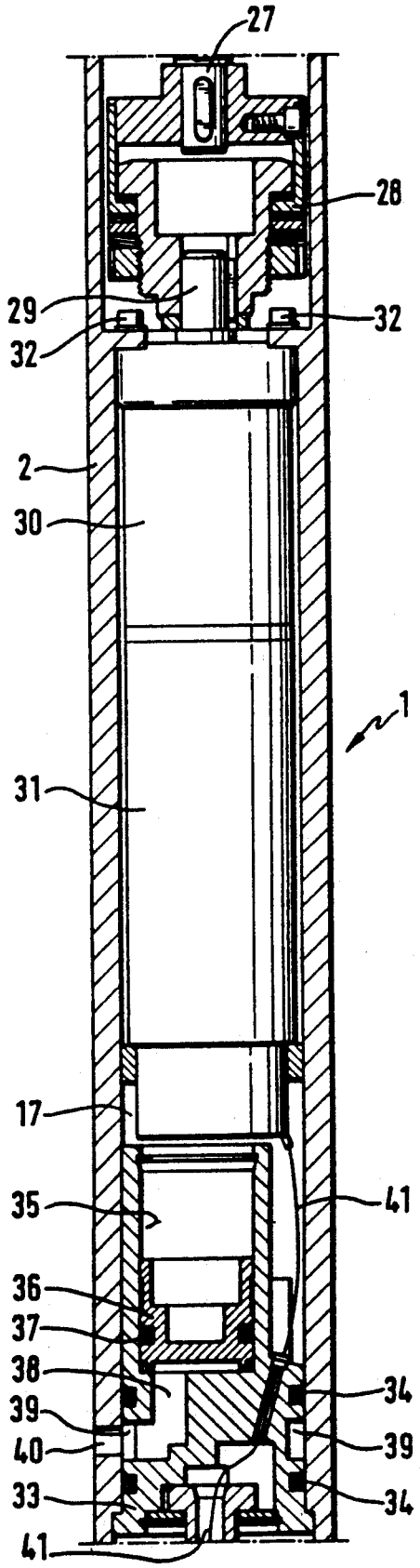
FIG. 2 shows a longitudinal section through a further portion, connecting to the lower end portion, shown in FIG. 1, of the measuring probe.

The upper end portion of the measuring probe 1 illustrated in Figure 1 contains a hydromechanical signal transmitter 5 with a stator 6 disposed in the housing 2 and a rotor 7 that is rotatable relative to the stator 6. The stator 6 has passages 8, 9 aligned with each other on both sides of the rotor 7 and having the form of cylindrical holes, which passages are disposed at equal distances from the rotor axis and extend parallel thereto. The passages 8 are located upstream from the rotor 7 and are in communication via inlet holes 10 with inlet openings 11 in the upper face 12 of the housing 2. From the passages 9 which are downstream from the rotor 7, outlet holes 13 lead to outlet openings 14 disposed in the cylindrical shell surface of the housing 2.

Figure 3:
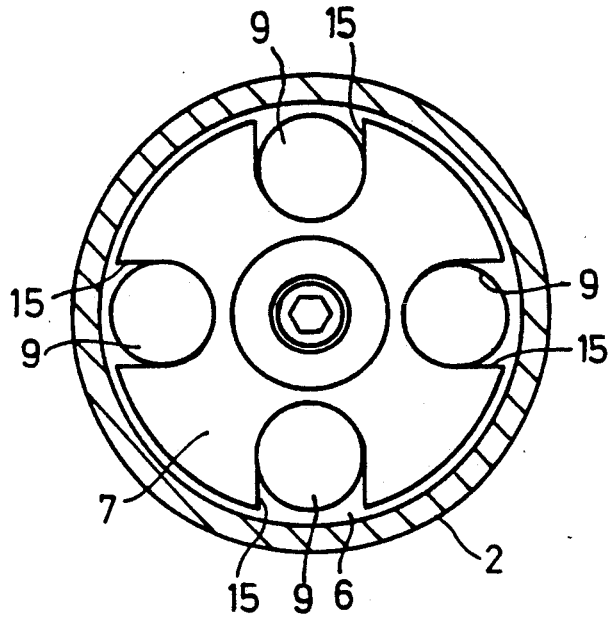
FIG. 3 shows a cross section of the measuring probe along the line III—III in FIG. 1.
Figure 4:
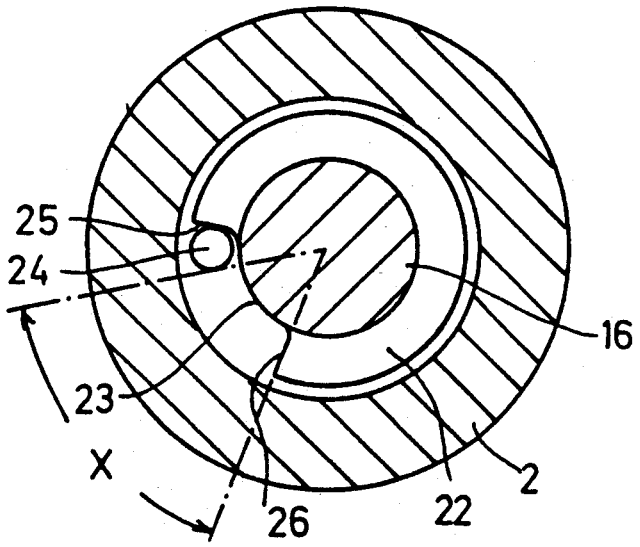
FIG. 4 shows a cross section of the measuring probe along the line IV—IV in FIG. 1.

The rotor 7 as shown in FIG. 3 has the form of a flat circular disk, which in its edge region has openings 15 that are disposed at spacings relative to one another, which in one position of the rotor 7 can be brought into coincidence with the passages 8, 9 in such a way that a liquid flow can pass almost unhindered through the openings 15 to the passages 8, 9. In the regions between the openings 15, the rotor has closed portions of such size that, after rotation of the rotor 7 by a predetermined angle, the passages 8, 9 of the stator 6 are covered by the disk of the rotor 7, so a liquid flow supplied through the inlet holes 10 to the passages 8 can arrive into the openings 15 only via small gaps present between rotor 7 and stator 6 and from there via further gaps can arrive at the passages 9. This leads to strong throttling of the liquid flow.

For support and rotation of the rotor 7, a drive shaft 16 is provided which is supported in axial and radial directions by means of rolling bearings 18 in a housing compartment 17 formed by the housing 2. One end 19 of the drive shaft 16 projects upward through a hole 20 out of the housing compartment 17, where it is joined torsionally rigidly to the rotor 7. A seal 21 seals the drive shaft with respect to the hole 20. The drive shaft has an annular shoulder 22 which is provided with a recess 23, in which there is located a stop pin 24 that is integral with the housing. The recess 23 extends over part of the circumference of the annular collar 22. The arc length of the recess 23 determines the magnitude of an angle of rotation x by which the drive shaft 16 and thus the rotor 7 is rotatable relative to the housing 2 and the stator 6. Radial stop faces 25, 26 limit the recess 23 in the circumferential direction and, in cooperation with the stop pin 24, define the limit positions of the rotor 7 in the respective directions of rotation.

In this connection the arrangement is set up such that, in the one limit position, when the stop face 26 s pressing against the stop pin 24, for example, the rotor 7 completely covers the passages 8, 9, while the openings 15 of the rotor 7 are each located centrally between passages 8, 9. This position corresponds to the previously designated throttling position. In the other limit position, in which the stop face 25 is pressing against the stop pin 24 after a rotation of the rotor by the angle of rotation x, the openings 15 of the rotor 7 are substantially aligned with the passages 8, 9. This position corresponds to the previously designated passing position.

Whereas when the rotor 7 is in throttling position it is stabilized in its position by the hydraulic forces that occur and therefore remains in this position even without application of relatively large force, the position of the rotor 7 is not stable when the openings 15 are aligned with the passages 8, 9 in the passing position, and so restoration of the rotor 7 to the throttling position can occur if the rotor 7 is not restrained. In order to avoid this, the angle of rotation x is made larger, by virtue of setting the stop face 26 farther back by a small amount to make the angle of rotation more than half of the angle that the spacing radii on which the openings 15 are located make with each other. Thereby the situation is achieved that the openings 15 in the passing position are sufficiently offset beyond the central position aligned with the passages 8 9 that the hydraulic forces that occur tend to turn the rotor 7 further in this direction. In this way the stop face 25 in the passing position is continuously pressed against the stop pin 24, and the rotor 7 is stabilized in this position without the need for additional measures.

The end 27 of the drive shaft 16 opposite the rotor 7 is connected through a torsionally flexible coupling 28, which cushions the impacts when the annular collar 22 encounters the stop pin 24, with the output shaft 29 of a drive assembly that consists of a step-down gear 30 and a d.c. motor 31. The drive assembly is fixed by means of screws 32 in the housing compartment 17. The bottom end of the housing chamber 17 adjacent to the d.c. motor 31 is closed by a wall element 33, which is sealed with respect to the housing 2 by seals 34.

In the wall element 33 there is located a cylindrical hole 35, in which an equalizing piston 36 is axially slidingly disposed. The seal 37 seals the equalizing piston 36 with respect to the cylindrical hole 35. The cylindrical hole 35 is open to the housing compartment 17. The end of the cylindrical hole 35 separated by the equalizing piston 36 from the housing compartment 17 is in communication via a hole 38 with an annular slot 39 communicating with a hole 40 through the housing 2. By virtue of this communication, the side of the equalizing piston 36 away from the housing compartment 17 is acted upon by the surrounding pressure prevailing outside the measuring probe 1. The housing compartment 17 is completely filled with a liquid that has favorable lubricating and corrosion-inhibiting characteristics together with low viscosity and low electrical conductivity. Furthermore, the liquid is preferred to be temperature-resistant and have a high boiling point, so that the probe can be employed even at relatively high surrounding temperatures.

The d.c. motor 31 is connected by a connecting cable 41, which is led pressure tightly through a hole in the wall element 33, with signal-control devices disposed in a lower portion of the measuring probe 1 that is no illustrated, via which devices the d.c. motor can be reversibly activated by reversing direction of the current applied through cable 41, in order to execute respective opposite rotational movements and to move the rotor 7 from one limit position into the other. Since current direction and direction of rotation correspond to each to each other in each case, the two rotor limit positions are unambiguously defined by the current directions of control signals applied cable 41 and a mistake in identification of the two signal forms—pressure high, pressure low—is precluded.

The generation of the pressure signals is achieved during operation of the described measuring probe by continuous movement of the rotor 7 forward and back from one limit position to the other. If the rotor 7 is located in the passing position, the fluid flow required by the drill string can on the one hand flow between the guide ribs 4, along the outside of the measuring probe 1, and can on the other hand flow through the measuring probe via the inlet openings 11, the inlet holes 10, the passages 8, the openings 15, the passages 9, the outlet hole 13 and the outlet openings 14. If the rotor 7 is moved into the throttling position, the flow cross section inside the measuring probe 1 is almost completely closed, which leads to a sudden pressure rise in the fluid flow above the measuring probe 1. The pressure rise propagates to the surface through the drilling fluid, where it can be picked up by a receiver. If the rotor 7 is reset thereafter into the passing position, the entire flow cross section once again becomes available to the fluid flow, and so the pressure drops again to the previous level, which can also be measured at the surface. By means of a rapid train of such control movements, measuring signals coded in this way can be sent as pressure pulses via the drilling fluid to the surface The described sequence is illustrated by the diagrams presented in FIG. 5.

Figure 7:
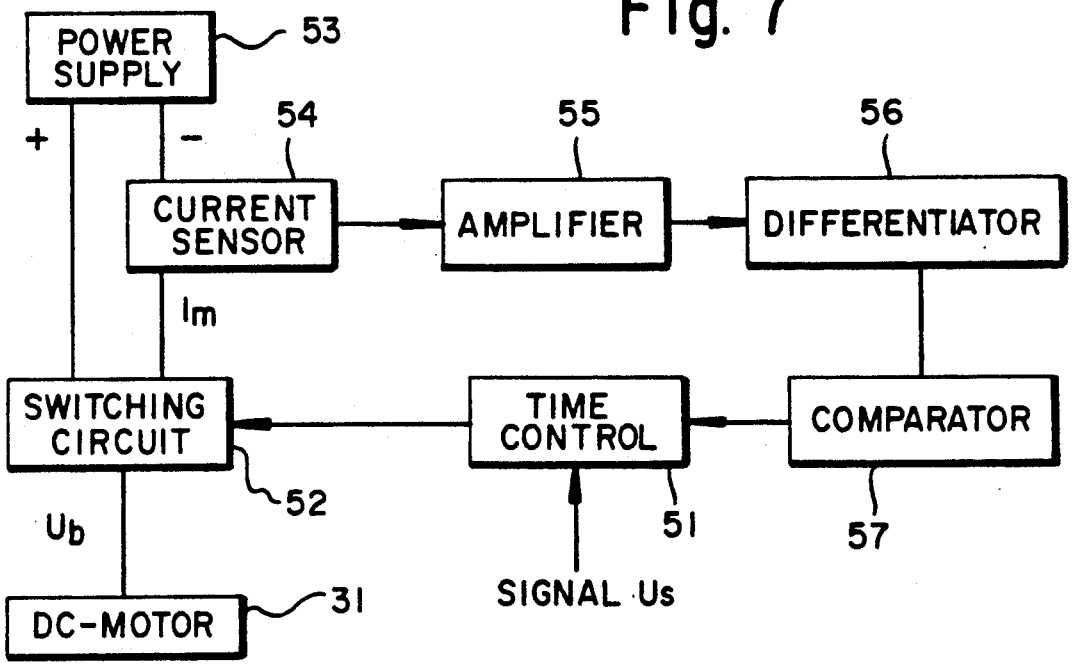
FIG. 7 shows block diagram of a control circuit for motor control.
Figure 8:
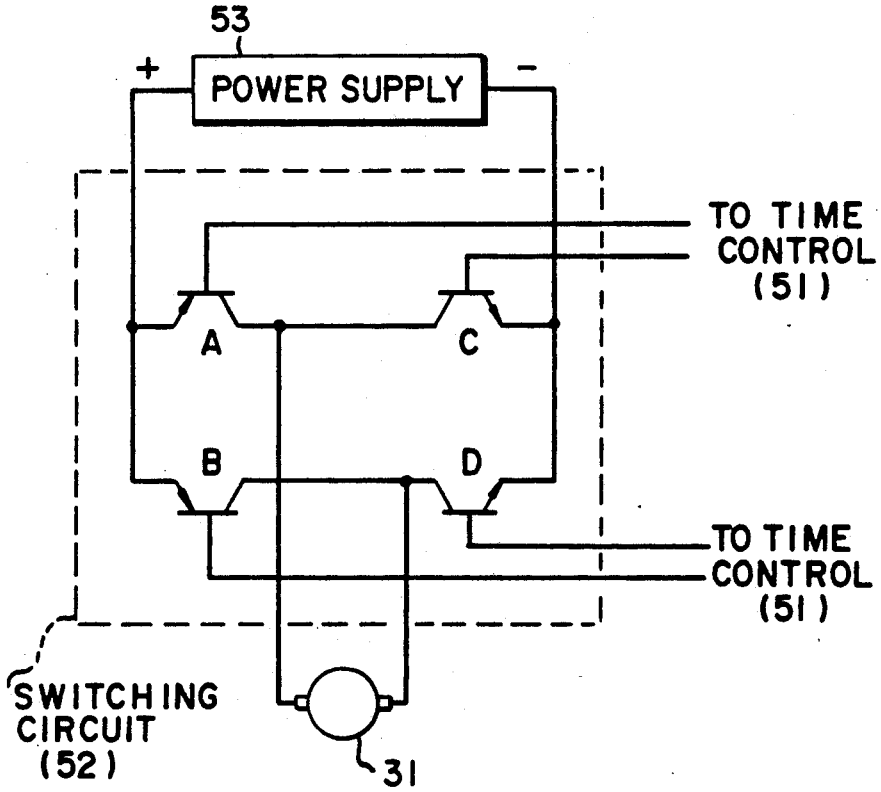
FIG. 8 shows a transistor switching circuit for driving the motor in either direction.

FIG. 7 shows in block diagram form a circuit for controlling the reversible motor 31 in response to a signal $U_s$ representing a measured value. A time control circuit 51 provides control signals to a switching circuit 52 which controls timing and polarity of voltage fed to motor 31 from power supply 53 by switching on and off four transistors A, B, C and D forming a bridge circuit as shown in FIG. 8.

Figure 5:
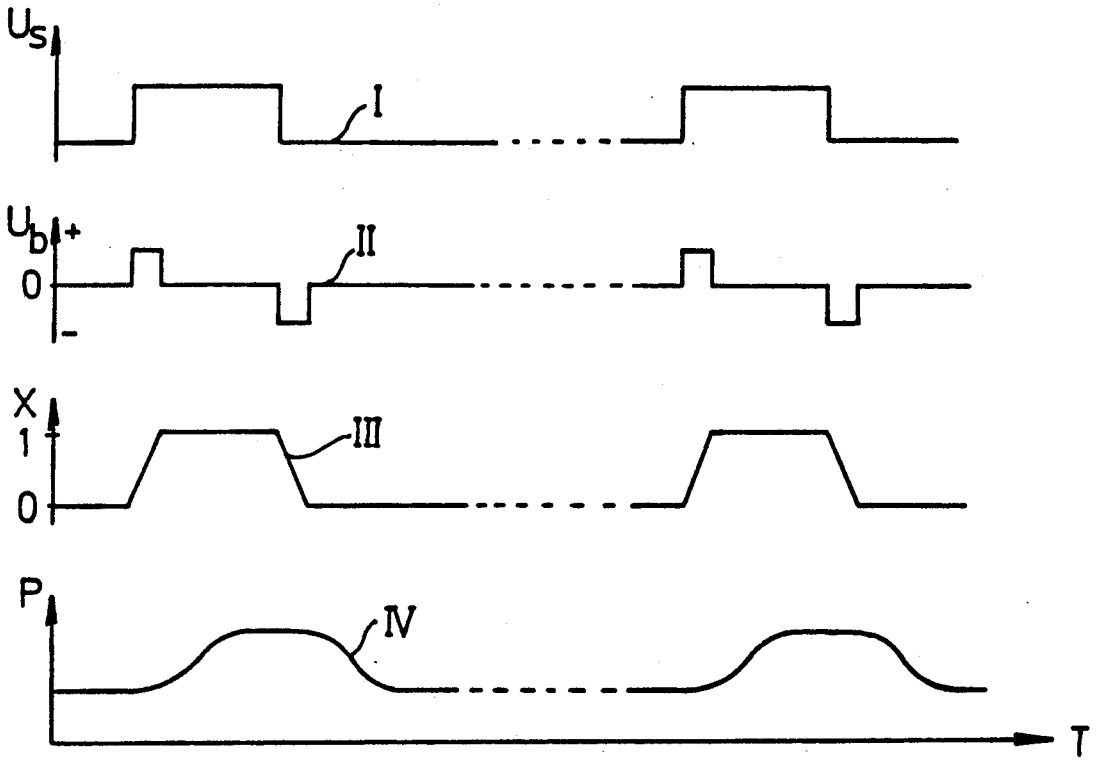
FIG. 5 shows a diagram to illustrate the electrohydraulic signal transformation.

The curve I in FIG. 5 shows the time variation of the signal voltage $U_s$, which describes a measured value of the measuring probe 1 in coded, digital form. Upon a change of the signal voltage $U_s$, the d.c. motor 31 is in each case switched to an operating voltage $U_b$ until the rotor 7 has been moved in each case from one limit position into the other limit position. The line II reproduces the corresponding variation of the operating voltage $U_b$ present at the d.c. motor 31 versus the time T. The line III shows the corresponding angle of rotation x of the respective position of the rotor 7, the angle of rotation $x=0$ representing the passing position and $x=1$ representing the throttling position. From the respective position of the rotor 7 according to line III, a rise of the pressure P in the liquid column located above the measuring probe 1 results as shown by line IV, with a time delay caused by the compressibility of the liquid medium used as drilling fluid. At the surface, this pressure rise, which can amount to 10 bar, for example, is sensed as a pressure pulse by a pressure sensor and evaluated by an evaluating unit.

The starting and direction of rotation of the d.c. motor 31 is determined by the signal $U_s$, which is received at the time control circuit 51. One pair of the transistors A, D or B, C is controlled to be conductive while the other pair is made non-conductive, providing voltage pulses $U_b$ to drive the motor in one direction or the other. All of the transistors are made non-conductive to stop rotation of the motor. The transistors may also be switched so voltage that builds up in the armature due to rotation after the transistor are switched off provides an opposing force that brakes the rotational movement of the motor.

Figure 6:
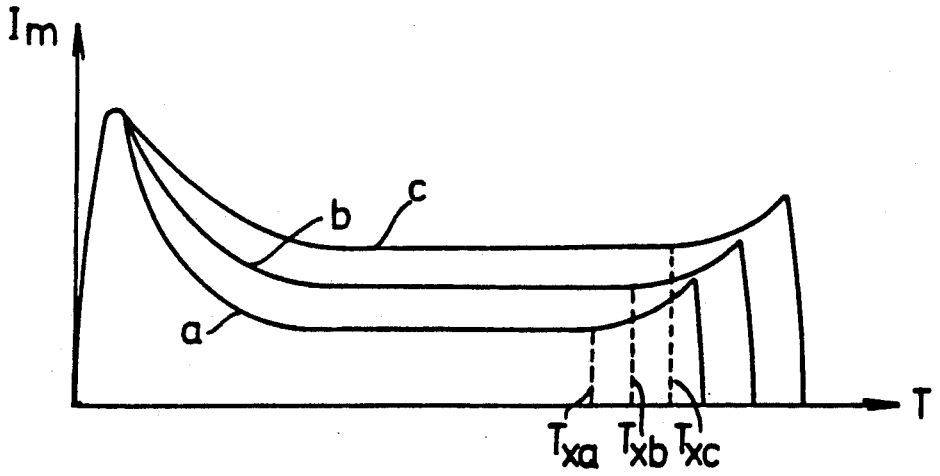
FIG. 6 shows a diagram to illustrate the motor control.

In FIG. 6, the current consumption $I_m$ of the d.c. motor is plotted versus the time T during a switching phase in which the d.c. motor is energized with the operating voltage $U_b$ by time control circuit 51. The curves a, b, c represent different operating situations that result from different resistances to rotation of the rotor 7. When the d.c. motor is switched on, the current $I_s$ first increases to a maximum value and, in the cases of a low resistance to rotation of the rotor 7, assumes a time variation represented by the line a. Because of the relatively low resistance to rotation, the limit position of rotor 7 is reached after a time $T_{xa}$. The rotor 7 is now unable to turn further, and so the resistance to rotation increases as function of the torsional flexibility of the coupling 28 and of the angular momentums of the masses that are in rotation, this situation being associated with an increase of the current $I_m$.

This increase of the current $I_m$ is sensed by a current sensor 54, processed through amplifier 55, differentiator 56 and comparator 57 to provide a signal to time control circuit 51 that causes the d.c. motor to be switched off. If the resistance to rotation of the rotor 7 is relatively high, a variation of the current input $I_m$ to the d.c. motor according to line b or c can occur. The limit position of the rotor 7 is reached after a time $T_{xb}$ is the case of line b, and after a time $T_{xc}$ in the case of line c. The higher the resistance to rotation of the rotor 7 is, the greater is also the current input to the d.c. motor and the longer is the time needed to travel through the angle of rotation x. Since the switching-off of the d.c. motor depends primarily on the increase of the current input $I_m$ after the stop position is reached, however, the time fluctuations related to the resistance to rotation do not have an interfering influence on the operating behavior. In each case the motor remains connected until the rotor has reached its limit position, and the on-duration of the motor is adapted optimally to the respective time needed in order to achieve minimum current consumption. In addition, the switching-off of the d.c. motor can be brought about by a disconnection function in time control circuit 51, by which the motor is also switched off after a predetermined maximum on-duration. This can be advantageous in order to limit the on-duration of the motor to a maximum value in the case of blocking of the rotor and failure of the current-increase signal caused thereby. Thus activation of the timer disconnection function can also be evaluated as a monitoring signal for indication of an operating fault.

We claim:

1. A hydromechanical signal transmitter apparatus for transmitting information signals in a flowing liquid medium by generation of pressure pulses in the medium comprising:

a housing (2) of generally cylindrical form having an axis;

a hydromechanical signal transmitter (5) in said housing, said transmitter comprising a stator (6) fixed within the housing and a disc shaped rotor (7) rotatable relative to the stator about said axis;

said stator having at least one pair of liquid passage (8,9) extending through said housing for passing fluid of said liquid medium therethrough, said at least one pair of passages being axially aligned with each other and disposed on opposite sides of said disc shaped rotor (7);

said disc shaped rotor (7) having openings (15) formed therein at positions corresponding to each of said at least one pair of passages, said rotor being rotatable between a passing position wherein fluid in said passages (8,9) passes through a corresponding opening (15) aligned therewith and a throttling position wherein said rotor is moved to a position such that flow of fluid through said passages is obstructed by a closed portion of said disc shaped rotor;

drive shaft means (16) connected to said rotor for rotating the rotor between said passing position and said throttling position, said drive shaft means having radial stop faces (25,26) which abut against a stop means (24) integral with said housing to stop rotation of said rotor at limit positions corresponding to said passing and throttling positions, respectively; and reversible motor means for driving said shaft means in accordance with information signals provided thereto to control movement of said rotor of said hydromechanical signal transmitter (5) between said limit positions to generate pressure pulses in said fluid corresponding to said signals.

2. An apparatus as recited in claim 1, wherein said radial stop face (25) that stops rotation of said rotor (7) at said passing position limit position is set such that said openings (15) are eccentrically offset from a position of alignment with the passages (8,9) such that hydraulic force of fluid therein maintains said stop face (25) pressed against said stop means (24) when said rotor is at the passing position to stabilize the rotor in this position.

3. An apparatus as recited in claim 1, wherein said stator (6) has a plurality of pairs of passages (8,9) equally spaced circumferentially in said housing (2), and said rotor (7) has an equal number of openings (15) which are spaced corresponding to the passages, respectively.

4. An apparatus as recited in claim 1, wherein each of said at least one pair of axially aligned passages has substantially the same cross section.

5. An apparatus as recited in claim 1, wherein said reversible motor means includes a reversible motor (31) connected to a power supply (53), and a time control circuit (51) for controlling duration of rotation and direction of rotation of said motor by means of a switching circuit (52) connected between said motor and said power supply to control current to said motor.

6. An apparatus as recited in claim 5, further including current sensor means (54) in circuit between said motor (31) and said power supply (53) and mean for detecting an increase in current caused when said motor has reached a limit position and for providing a signal to said time control circuit (51) to switch off the motor upon detecting such increase.

7. An apparatus as recited in claim 6, wherein said time control circuit (51) operates to control said switching circuit (52) to switch said motor (31) to operate as a generator during the switching-off process.

8. An apparatus as recited in claim 5, 6 or 7, wherein said switching circuit (52) comprises a plurality of power transistors which are selectively made conductive and non-conductive.

9. An apparatus according to any one of claims 1–7 wherein said reversible motor means comprises a drive shaft (16) and a torsionally flexible coupling (25) connecting said motor (31) with said rotor (7).

10. An apparatus according to claim 9, wherein said reversible motor means further comprises a step-down gear (30).

11. An apparatus according to claim 1, wherein at least a portion of said reversible motor means is disposed in a pressure-tight housing compartment (17) filled with a liquid medium of low viscosity, said housing compartment including a pressure equalizing piston (36) acted on by surrounding pressure and disposed slidingly within said housing compartment.

* * * * *